US008545350B2

(12) United States Patent
Goodwin et al.

(10) Patent No.: US 8,545,350 B2
(45) Date of Patent: Oct. 1, 2013

(54) EXPANDABLE ARROWHEAD WITH SIDEWAYS EJECTABLE SIGNAL GENERATOR

(76) Inventors: Thomas E. Goodwin, Eagle, ID (US); Gary S. Welch, Boise, ID (US)

( * ) Notice: Subject to any disclaimer, the term of this patent is extended or adjusted under 35 U.S.C. 154(b) by 42 days.

(21) Appl. No.: 13/422,865

(22) Filed: Mar. 16, 2012

(65) Prior Publication Data

US 2013/0072331 A1 Mar. 21, 2013

Related U.S. Application Data

(60) Provisional application No. 61/453,439, filed on Mar. 16, 2011.

(51) Int. Cl.
*F42B 6/08* (2006.01)

(52) U.S. Cl.
USPC ..... 473/583

(58) Field of Classification Search
USPC ..... 473/578, 582, 583, 584
See application file for complete search history.

(56) References Cited

U.S. PATENT DOCUMENTS

| | | | | |
|---|---|---|---|---|
| 4,858,935 | A | 8/1989 | Capson | |
| 4,940,245 | A | 7/1990 | Bittle | |
| 4,976,442 | A | 12/1990 | Treadway | |
| 5,188,373 | A * | 2/1993 | Ferguson et al. | 473/583 |
| 5,446,467 | A | 8/1995 | Willett | |
| 6,409,617 | B1 | 6/2002 | Armold | |
| 6,764,420 | B2 | 7/2004 | Cyr et al. | |
| 6,814,678 | B2 | 11/2004 | Cyr et al. | |
| 6,830,523 | B1 * | 12/2004 | Kuhn | 473/583 |
| 6,856,250 | B2 | 2/2005 | Hilliard | |
| 7,232,389 | B2 | 6/2007 | Monteleone | |
| 7,300,367 | B1 | 11/2007 | Andol et al. | |
| 2009/0098958 | A1 | 4/2009 | Miner | |
| 2012/0220399 | A1 * | 8/2012 | Ferguson | 473/570 |

* cited by examiner

*Primary Examiner* — John Ricci
(74) *Attorney, Agent, or Firm* — Pedersen and Company, PLLC; Ken J. Pedersen; Barbara S. Pedersen

(57) ABSTRACT

An expandable hunting arrowhead which ejects a signal generator and transmitter into the body of the quarry animal upon impact is described. The action of expanding blades, which rotate radially outwardly and backwardly to deploy from the sides of the arrowhead upon impact, separates the tip of the arrow containing the signal generator and transmitter in a sideways manner from the rest of the arrowhead. The sideways separation is obtained as a result of the rotating action of the blades, and the linear action of a plunger acted upon by the blades within the arrowhead. This way, the signaling tip is more likely to stay within the body of the animal, and not pass through it, to help the hunter locate the body.

4 Claims, 8 Drawing Sheets

EXPANDABLE ARROWHEAD WITH SIDEWAYS EJECTABLE SIGNAL GENERATOR

This application claims priority from U.S. Provisional Patent Application Ser. No. 61/453,439, filed Mar. 16, 2011, the entire disclosure of which is incorporated herein by this reference.

BACKGROUND OF THE INVENTION

1. Field of the Invention

This invention relates generally to hunting arrowheads in archery. More specifically, this invention relates to an arrowhead which is especially adapted to eject a signal generator/transmitter sideways into a quarry animal upon impact with the animal, to assist in location of the struck quarry animal.

2. Related Art

U.S. Pat. No. 4,858,935, Capson, discloses a hunting arrow with a signal generator which is positioned near the middle of the shaft of the arrow, and which signal generator is ejected by a spring into the body cavity of the quarry upon impact.

U.S. Pat. No. 4,940,245, Bittle, Jr., discloses a hunting arrow with a signal generator which is positioned annularly of the arrow shaft, just behind the broadhead. The signal generator is separable from the arrow upon impact The signal generator has barbed points which are driven into the body of the struck animal quarry, thus firmly attaching the signal generator to the quarry animal.

U.S. Pat. No. 4,976,442, Treadway, discloses an arrow with a removable transmitter which fits in a notch in the arrow shaft, the transmitter having a curved hook facing towards the front of the arrow. When the arrow impacts the quarry animal, the hook engages in the animal's body, and the transmitter separates from the arrow and remains with the hook in the animal's body so the struck animal may be located.

U.S. Pat. No. 5,446,467, Willet, discloses a transmitter mounted on one side of a hunting arrow, just behind the broadhead, with a counter balance weight on the other side of the arrow, in order to provide ballistic balance. The transmitter has a sharp dart on its front end for impacting, penetrating the animal's body, separating from the arrow and remaining in the body of the quarry animal.

U.S. Pat. No. 6,409,617 Armold, discloses a hunting arrow with a signal transmitter near the back of the broadhead in a central bore. The front of the broadhead acts as a plunger upon impact, forcing back onto the transmitter, and ejecting the transmitter sideways into the body of the struck quarry.

U.S. Pat. No. 6,856,250, Hilliard, discloses a hunting arrow with a break-away signal transmitter that is connected to a collar around the shaft of the arrow just behind the broadhead.

U.S. Pat. No. 7,232,389, Monteleone, also discloses a hunting arrow with a break-away signal transmitter that is connected to a collar around the shaft of the arrow just behind the broadhead.

U.S. Pat. No. 7,300,367, Andol, et al., also discloses a hunting arrow with a signal transmitter that is connected to a collar around the shaft of the arrow just behind the broadhead. In Andol, et al., the collar is an elastomeric ring which flexes, but does not break, upon impact of the arrow to dislodge the transmitter into the body of the struck animal.

US Published Patent Application #US2009/0098958, Miner, discloses a hunting arrow with a removable signal transmitter on a barbed-hook insert in the shaft of the arrow just behind the broadhead.

SUMMARY OF THE INVENTION

The present invention is a hunting arrowhead with an expandable head which ejects a signal generator and transmitter into the body of the quarry animal upon impact of the arrow. The action of sharp, expanding blades, which rotate radially out to deploy backwardly from the sides of the arrowhead upon impact, separates parts of the tip of the arrowhead containing the signal generator and transmitter in a sideways manner from the rest of the arrow in order to leave the signal generator/transmitter behind in the body of the struck quarry. The sideways separation is obtained by the action of the inboard end of the rotating blades pushing a plunger with a slanted front surface forwardly against the cooperating slanted back surface of the parts containing the signal generator and transmitter. The relative movement of the parts along the cooperating slanted surfaces ensures that the signal generator and transmitter are pushed sideways out of the trajectory path of the rest of the arrow, and into the body of the struck quarry. This way, the signal generator/transmitter remains in the body of the animal, and can help the hunter locate its body.

DETAILED DESCRIPTION OF ONE EMBODIMENT OF THE INVENTION

Referring to the Figures, there is shown one, but not all, embodiment of the present expandable arrowhead with sideways ejectable signal generator.

Figure 1:
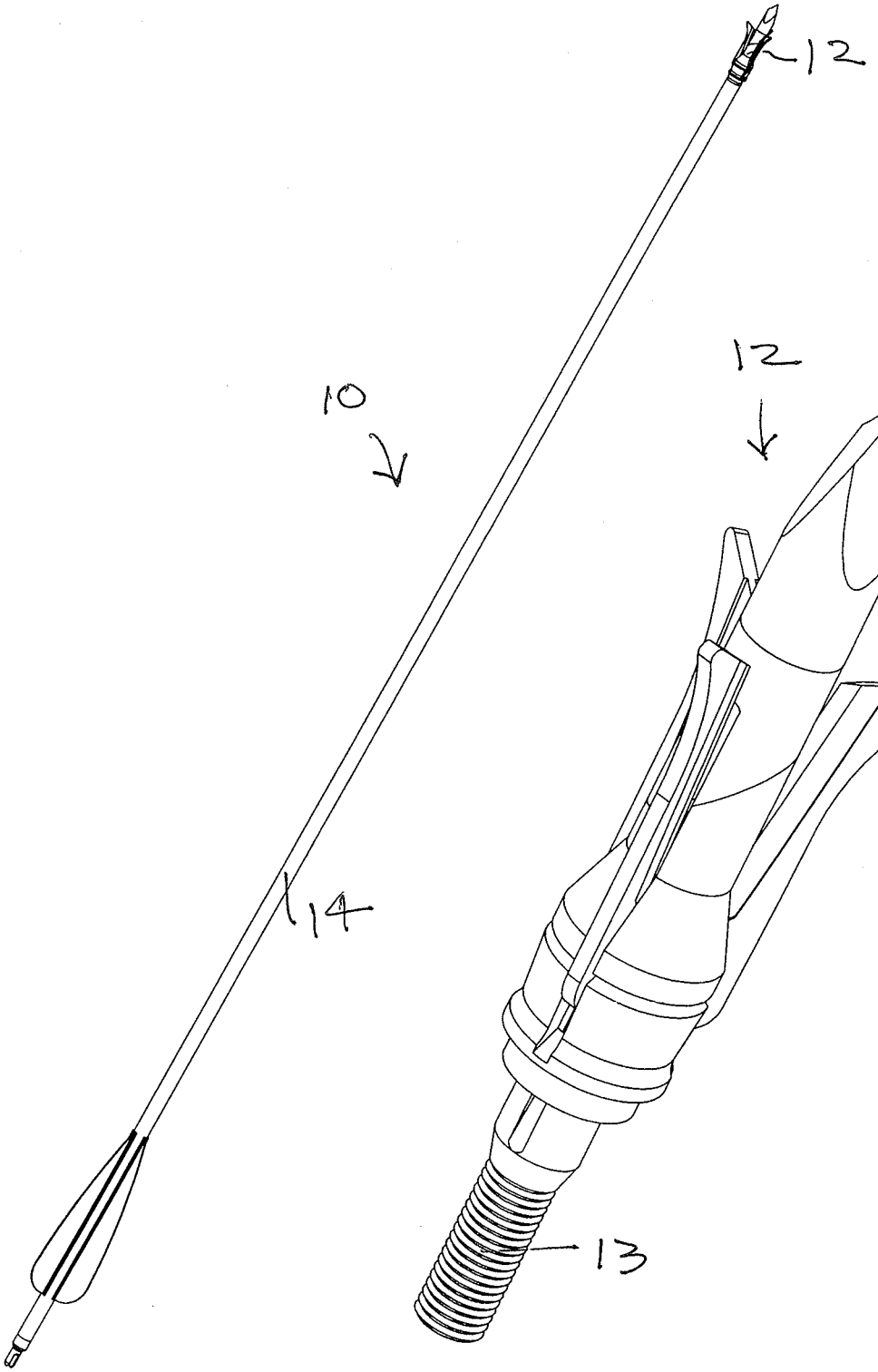
FIG. 1 is a side perspective view of an arrow with an arrowhead which is one embodiment of the present invention.
Figure 2:
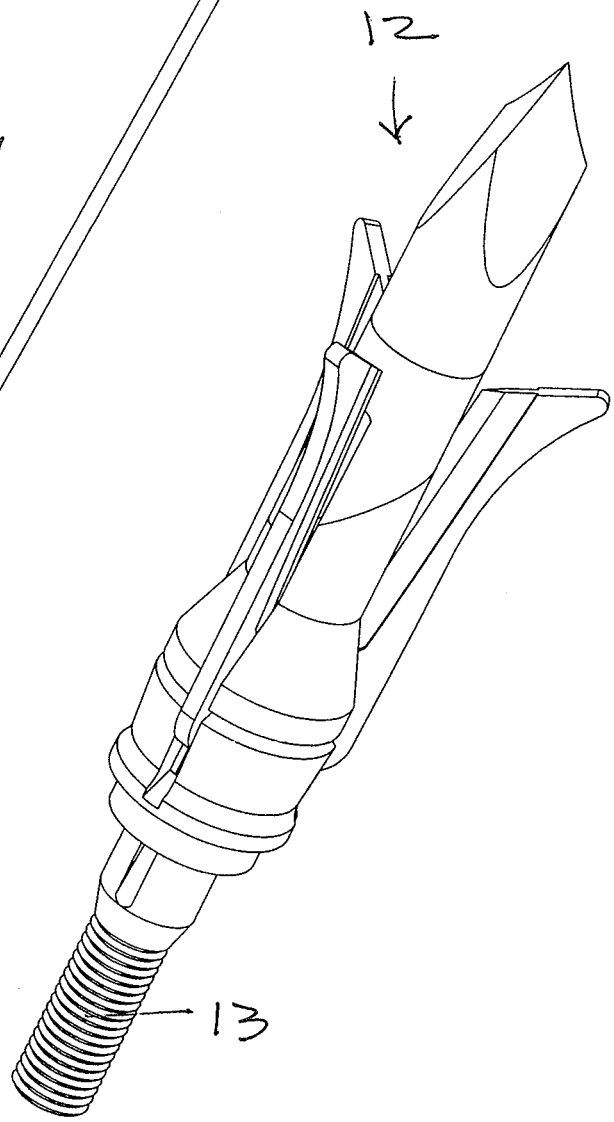
FIG. 2 is an enlarged side perspective detail view of the arrowhead of FIG. 1 removed from the arrow.

FIGS. 1 and 2 depict one combination (10) of one embodiment of the present invention, with the arrowhead 12 with the arrow 14 of FIG. 1 being removed therefrom and shown in greater detail in FIG. 2. Arrowhead 12 may be connected to the front end of arrow 14 in any conventional manner. As shown, arrowhead 12 is screwed into the front end of the arrow 14 shaft via threads 13 at the back of arrowhead 12.

Figure 3:
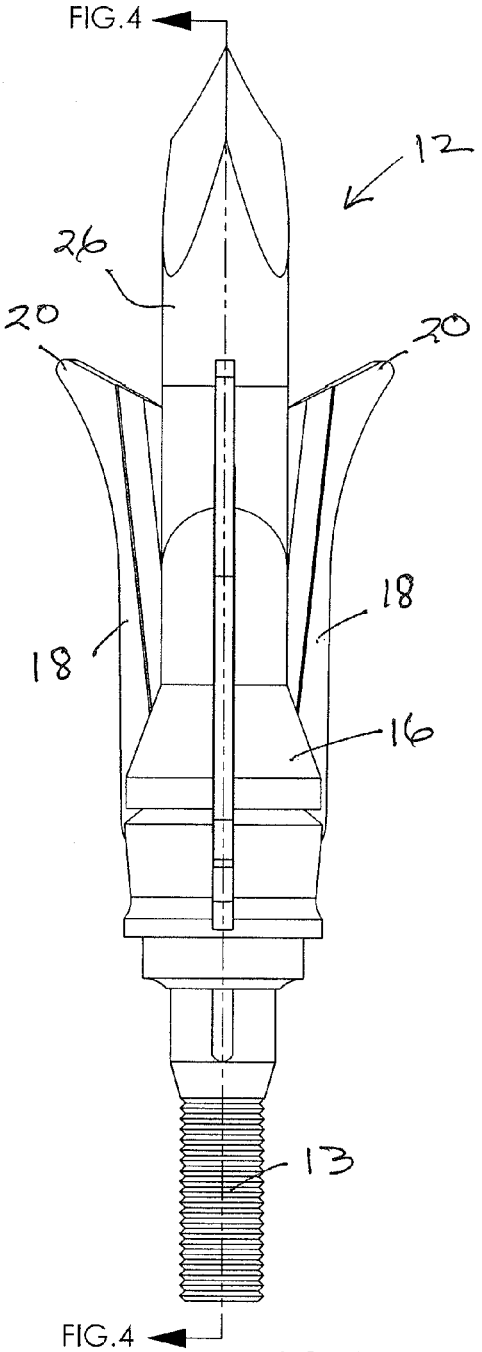
FIG. 3 is a further enlarged side view of the arrowhead depicted in FIG. 2.
Figure 4:
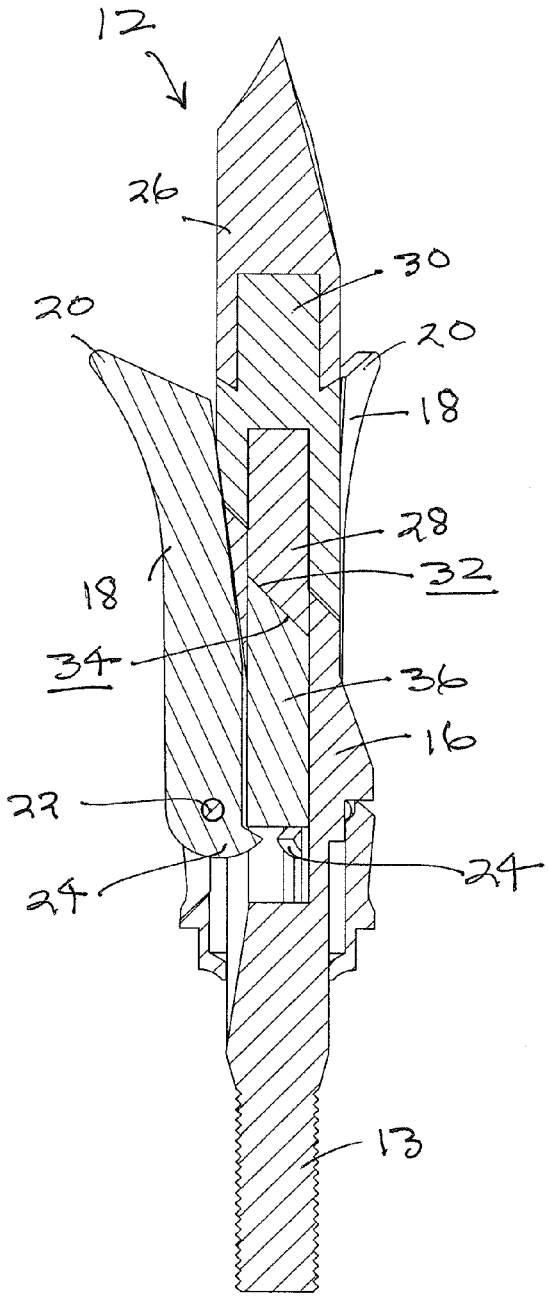
FIG. 4 is a side, cross-sectional view taken along line 4-4 in FIG. 3.

FIGS. 3 and 4 are side views of arrowhead 12, with FIG. 4 being in cross-section. These Figures depict that arrowhead 12 has base 16 which screws into the front end of arrow 14 in conventional manner. For these and the following Figures, because the images are presented in portrait format, the descriptions refer to the top of the image which in use of the invention would normally be the front of the arrowhead, and the descriptions refer to the bottom of the image which would be the back of the arrowhead. Base 16 extends upwardly to become the main body of the arrowhead 12. Pivotally connected to base 16 are three (3) expanding blades 18, each blade 18 being sharpened on its inside edge, and each blade 18 having a rounded outboard leading edge 20. Herein, "outboard" means "outside" in the sense of further away from the centerline of base 16. Each blade is rotatable to extend radially outwardly from base 16. Upon impact, leading edge 20 catches on the body of the target, pulling blade 18 outwardly and downwardly as the arrowhead 12 continues to pass further into the struck target. Axle 22 pivotally connect blades 18 to base 16. Axle 22 may be a horizontal metal ring within base 16, for example, which ring secures all three blades 18, but lets them rotate freely. Each blade 18 has a bottom inboard end 24 which extends radially inwardly towards the center of body 16. Inboard end 24 acts as a lifting lever so that when blades 18 rotate radially outwardly and downwardly, the inboard ends 24 rotate inwardly and upwardly to assist in separating and lifting the separable parts of tip 26 away from the base 16. The lifting of tip 26 is accomplished by inboard end 24 pushing up on plunger 36 which in turn pushes up on the combination of the transmitter 28, antenna 30 and sharp tip 26. Herein, "inboard" means "inside" in the sense of closer to the centerline of base 16. Plunger 36 has slanted surface 34 on its top end, which slanted surface 34 matches and cooperates with slanted surface 32 on the bottom end of the combination of the transmitter 28, antenna 30 and sharp tip 26. This way, as the plunger 36, transmitter 28, antenna 30 and tip 26 are pushed up way from base 16, the slanted surfaces 32 and 34 interact in a non-linear manner, with the combination of the transmitter 28, antenna 30 and tip 26 tending to slip sideways due to the slanted surfaces, and separate sideways upon separation from the base 16. This way, the combination of the transmitter 28, antenna 30 and tip 26 may be ejected sideways into the body of the impacted quarry, and not pass through it, as base 16 and the rest of the arrow tends to continue to move approximately straight ahead, into and even through the body of the struck quarry.

Also, preferably the combination of transmitter 28, antenna 30 and tip 26 includes a battery (not shown) and a switch for the signal generator/transmitter circuitry. If the tip 26 is turned 90° clockwise, for example, relative to antenna 30, the battery is turned on, and all the circuits of the arrowhead become energizable. If the tip is then turned 90° counterclockwise, the battery is turned off and all the arrowhead circuits become de-energized. This way, the arrowhead circuits may be conveniently turned on for use in the field, and turned off to preserve battery life when not in use. Also, tip 26/transmitter 28/antenna 30 may include an impact-activated switch (not shown) which instantaneously turns the tip's signal generator/transmitter on upon impact. This way, even when the circuitry is turned on by the manual switch to become energizable, little or no power output is required from the battery until upon impact of the arrowhead, providing additional battery preservation.

Also, in the Figures tip 26 connects to transmitter 28 via an antenna 30. Preferably, the antenna 30 is a ceramic micro GPS antenna. Preferably, transmitter 28 is nested within and connected to antenna 30. The combination of the transmitter 28 with antenna 30 is the signal generator/transmitter, the electronic signaling device, or "micro tracker" component of the invention. Transmitter 28 in the Figures has a slanted bottom surface 32 which abuts with a cooperating slanted surface 34 on the top of plunger 36 beneath it. During rest the bottom of transmitter 28 preferably extends downwardly relative to the top of plunger 36, into a recess within plunger 36, and is provided with a slight friction fit therein.

In this description, reference is made to transmitter 28, antenna 30 and sharp tip 26, and to the combination and partial combinations thereof. For practice of the invention, these components may be present as one, two or three separate pieces, and they may be combined in any order from top to bottom of arrowhead 12, except it is preferred that the sharp tip 26 be present at the front of arrowhead 12, and it is required that transmitter 28 and antenna 30 be separable from base 16. Therefore, hereinafter reference to "tip 26" means "the combination or any partial combination of transmitter 28, antenna 30 and sharp tip 26".

Figure 5:
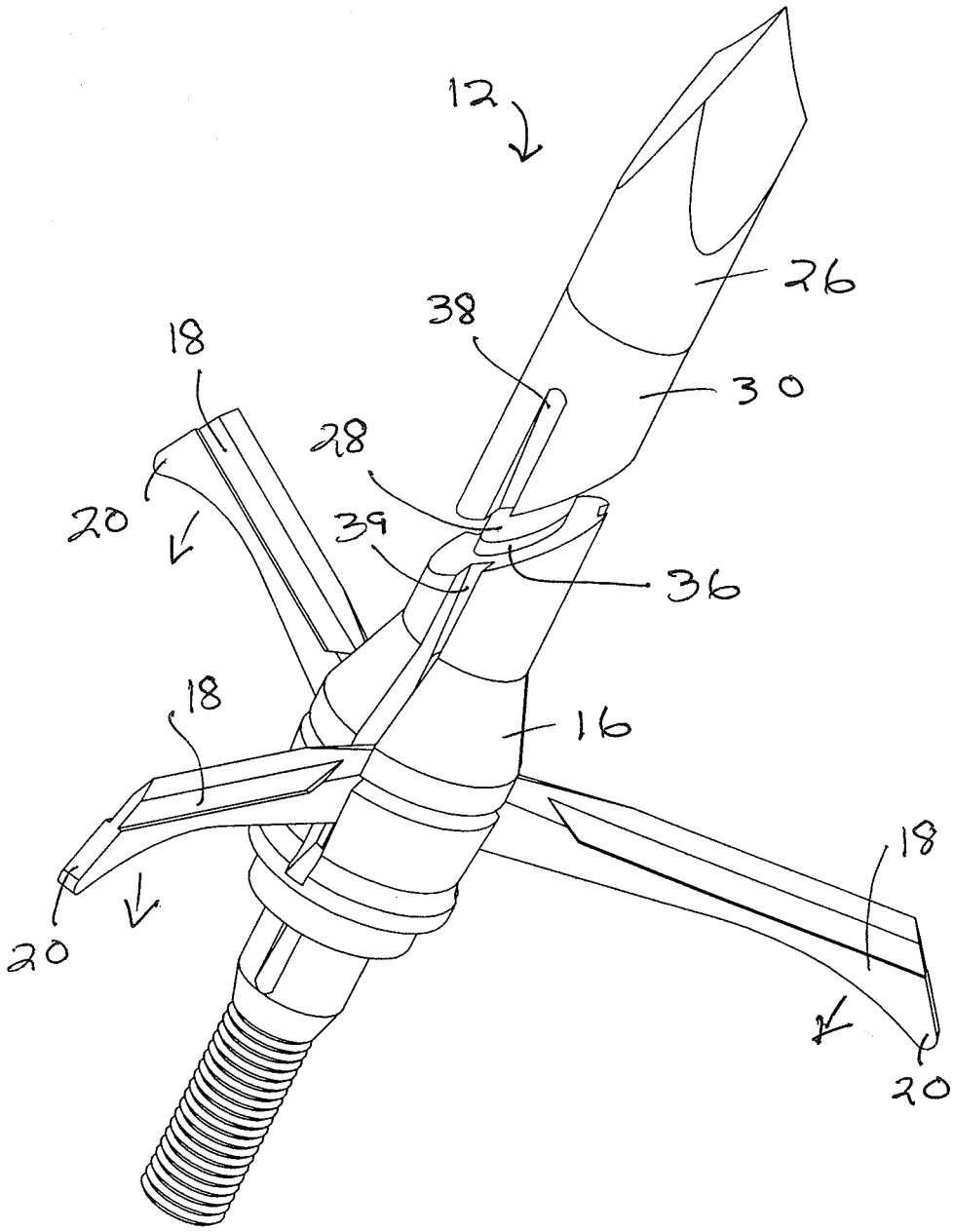
FIG. 5 is a further enlarged view of FIG. 2, but with the arrowhead blades partly opened out during their rotation/expansion, and with the tip containing the signal generator and transmitter beginning to be disengaged from the rest of the arrowhead.

FIG. 5 is a side, perspective view as in FIG. 2, but with the arrowhead blades 18 partly rotated out and down to become opened up their expansion, and the tip 26 beginning to be slightly disengaged from the base 16. In FIG. 5, a groove 38 in the side of tip 26 and a corresponding groove 39 in the side of base 16 for receiving blade 18 in its non-deployed position are visible. Preferably, there is a groove 38 and a groove 39 for each blade 18. The arrows with the blades 18 in FIG. 5 indicate the direction of movement of the blades during their rotation/expansion.

Figure 6:
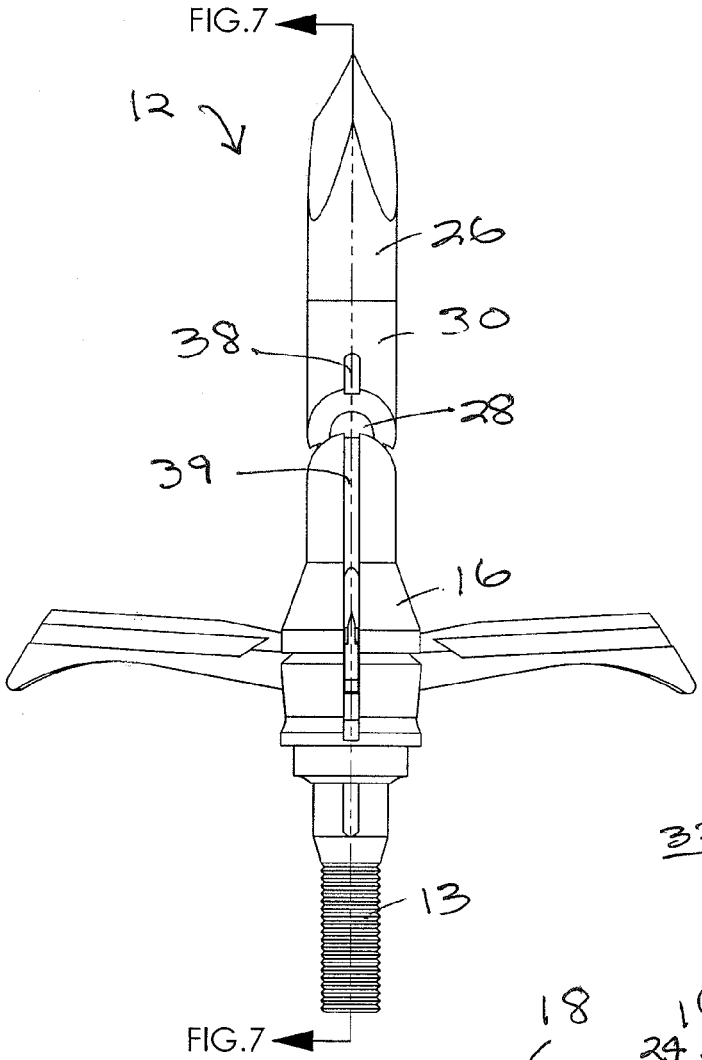
FIG. 6 is a reduced, smaller side view of the view depicted in FIG. 5.
Figure 7:
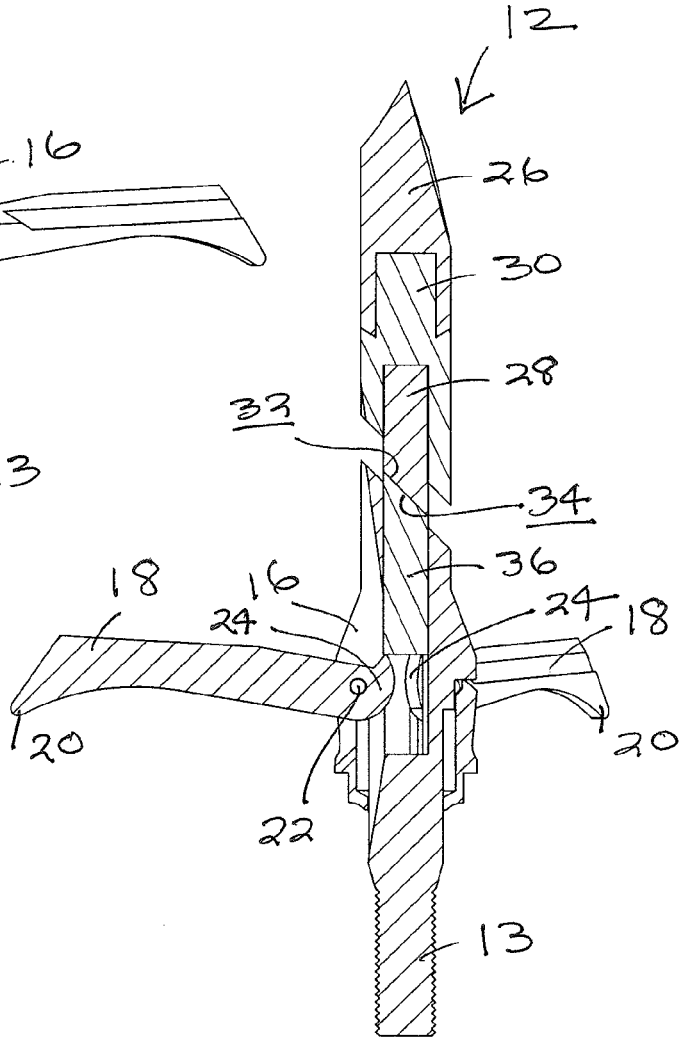
FIG. 7 is a side, cross-sectional view taken along line 7-7 in FIG. 6.

FIG. 6 is a side view of FIG. 5, and FIG. 7 is a side, cross-sectional view of FIG. 6 along the line 7-7 thereof. From these Figures, it is clear that, as blades 18 rotate outwardly and downwardly from tip 26, thereby the inboard end 24 of blade 18 rotates inwardly and upwardly, pressing up on the bottom end of plunger 36, and, in turn, tip 26, and thereby lifting the tip 26 upwardly and away from its resting place in base 16. This way, as blades 18 continue to move more outwardly and downwardly, tip 26 is urged further away from base 16.

Figure 8:
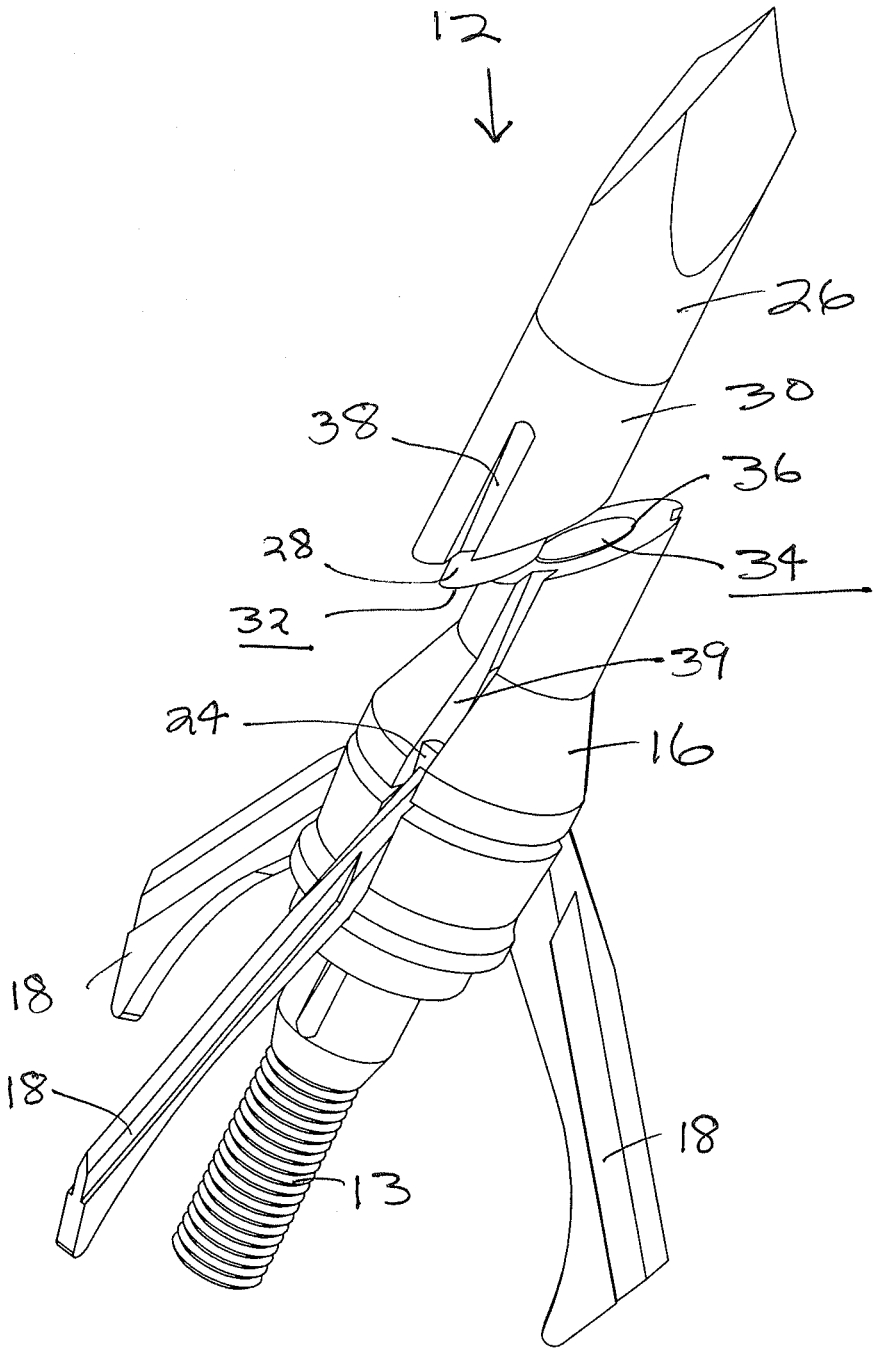
FIG. 8 is a view like in FIG. 5, but with the arrowhead blades fully rotated back and opened out, and with the tip nearly fully disengaged from the arrowhead.

FIG. 8 is a side, perspective view as in FIG. 5, but with the arrowhead blades 18 nearly fully opened out, and the tip 26 nearly fully disengaged from the base 16.

Figure 9:
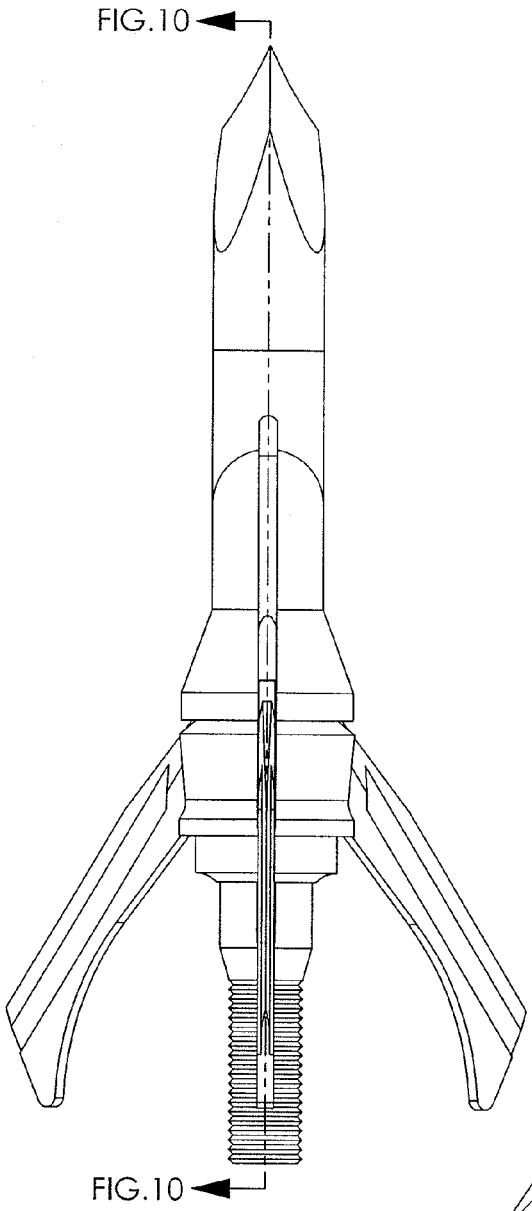
FIG. 9 is a reduced, smaller side view of the view depicted in FIG. 8.
Figure 10:
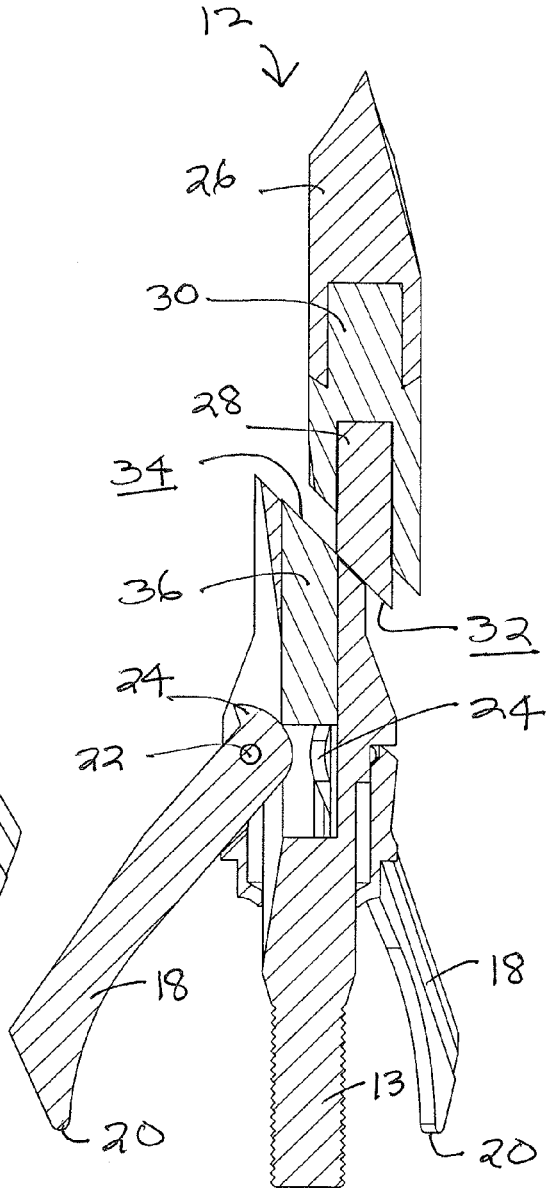
FIG. 10 is a side cross-sectional view taken along line 10-10 in FIG. 9.
Figure 11:
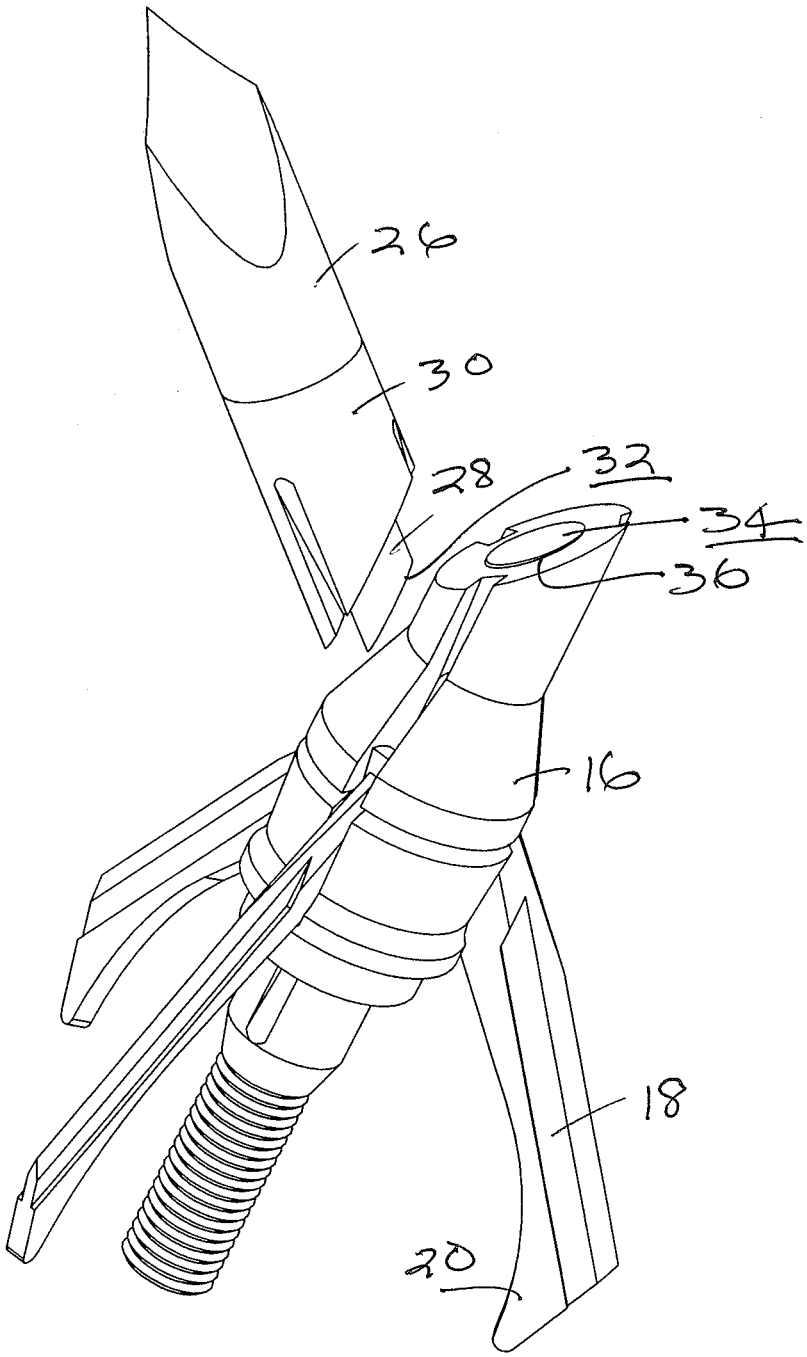
FIG. 11 is a view like in FIG. 8, but with the tip fully disengaged sideways from the arrowhead.

FIG. 9 is a side view of FIG. 8, and FIG. 10 is a side, cross-sectional view of FIG. 9 along line 10-10 thereof. From these Figures, it is clear that tip 26 may be completely dislodged and separated sideways from base 16 by the rotating action of blades 18 and the resulting linear action of plunger 36. In FIG. 11, tip 26 and its connected parts have become fully separated sideways from base 16.

Figure 12:
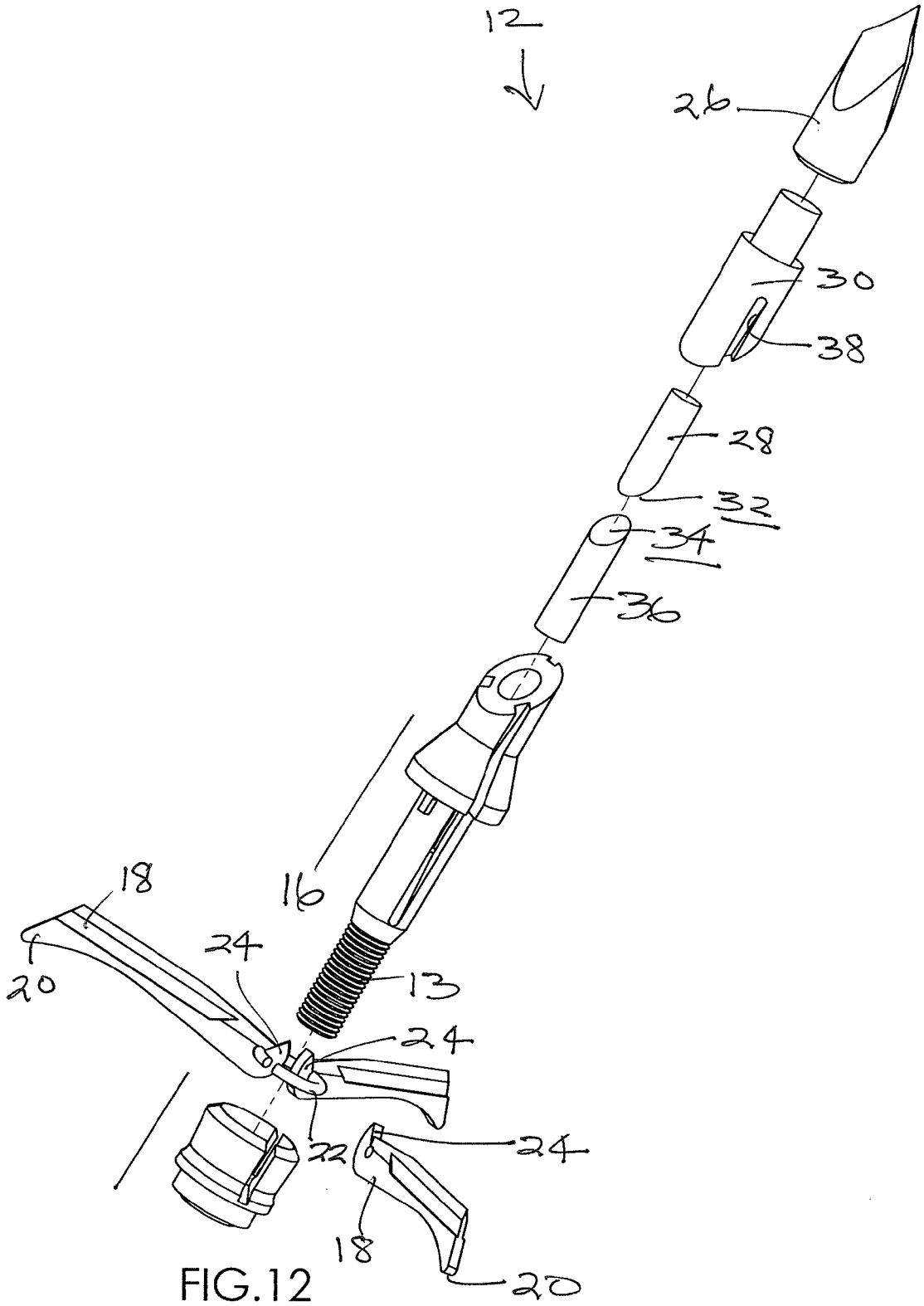
FIG. 12 is a side perspective exploded view of the embodiment depicted in FIGS. 1-11.

FIG. 12 is a side, perspective exploded view of arrowhead 12 of the present invention.

Although this invention has been described above with reference to particular means, materials and embodiments, it is to be understood that the invention is not limited to these disclosed particulars, but extends instead to all equivalents within the broad scope of the following Claims.

We claim:

1. An expandable arrowhead with a sideways ejectable signal generator and transmitter, comprising:

an elongate base with a top, a bottom, and a connector at its bottom end for connecting to the front end of an arrow;

an expanding blade connected to said base, said blade having an outboard end which rotates radially out from a side of said base towards the bottom thereof, said blade also having an inboard end which rotates up towards the top of said base when said blade outboard end rotates out;

a plunger within said base, said plunger being adapted to move up axially within said base when urged by the upward rotation of said blade inboard end, said plunger having a top slanted surface; and, a top end comprising a signal generator and transmitter, said top end having a bottom slanted surface which cooperates with the plunger top slanted surface, said top end being separable from said base when the plunger top slanted surface pushes up on the top end's bottom slanted surface.

2. The arrowhead of claim 1 comprising a plurality of expandable blades.

3. The arrowhead of claim 2 comprising three expandable blades.

4. The arrowhead of claim 1 wherein said top end comprises a battery, a switch, and an electrical circuit.

* * * * *